US005178380A

United States Patent [19]

Grossmann

[11] Patent Number: 5,178,380

[45] Date of Patent: Jan. 12, 1993

[54] COVERING DEVICE FOR A SIDE LAY OPENING IN A FEED TABLE OF A SHEET-PROCESSING MACHINE

[75] Inventor: Dieter Grossmann, Sinsheim/Reihen, Fed. Rep. of Germany

[73] Assignee: Heidelberger Druckmaschinen AG, Heidelberg, Fed. Rep. of Germany

[21] Appl. No.: 842,212

[22] Filed: Feb. 26, 1992

[30] Foreign Application Priority Data

Feb. 26, 1991 [DE] Fed. Rep. of Germany ..... 4105966

[51] Int. Cl.[5] ..... B65H 9/04

[52] U.S. Cl. ..... 271/250; 271/253

[58] Field of Search ..... 271/250, 253, 251, 252, 271/254, 255

[56] References Cited

U.S. PATENT DOCUMENTS 3,709,484 1/1973 Kistner ..... 271/255 X
4,844,441 7/1989 Motohashi .
5,022,638 6/1991 Ifkovits ..... 271/251 X

FOREIGN PATENT DOCUMENTS 0268693 10/1989 European Pat. Off. .

*Primary Examiner*—Richard A. Schacher

*Attorney, Agent, or Firm*—Herbert L. Lerner; Laurence A. Greenberg

[57] ABSTRACT

A covering device for a side-lay opening formed in a feed table of a sheet-processing machine and disposed transversely to a sheet-transport direction, wherein a bottom edge of at least one side lay for laterally aligning sheets travelling through the sheet processing machine in the sheet-transport direction dips into the side lay opening to a location below the surface of the feed table, a holder for the side lay being disposed on a guide and being adjustable transversely with respect to the sheet-transport direction, and cover web segments mutually juxtaposed and in alignment with the surface of the table being disposed adjacent the side lay for covering the side-lay opening, includes a spring device for bracing the cover web segments and biasing them in a direction perpendicular to the surface of the feed table, a sliding pad attached to the holder for the side lay, the sliding pad, in vicinity of the side lay, being actuable from above on the cover web segments for pressing the latter against the spring bias into the side lay opening, the sliding pad having a surface in alignment with the plane of the surface of the feed table adjacent to an inner side of the side lay directed towards a center of the sheet-processing machine.

13 Claims, 7 Drawing Sheets

COVERING DEVICE FOR A SIDE LAY OPENING IN A FEED TABLE OF A SHEET-PROCESSING MACHINE

The invention relates to a covering device for a side lay opening formed in a feed table of a sheet-processing machine and, more particularly, disposed transversely to a sheet-transport direction, wherein a bottom edge of at least one side lay for laterally aligning sheets travelling through the machine in the sheet-transport direction dips into the side lay opening to a location below the surface of the feed table, a holder for the side lay being disposed on a guide and being adjustable transversely with respect to the sheet-transport direction, and cover web segments mutually juxtaposed and in alignment with the surface of the table being disposed adjacent the side lay for covering the side lay opening.

Such a covering device has become known heretofore from FIG. 5 and from the associated portion of the specification in columns 2 and 3 of European Patent 0 268 693 wherein cover web segments are described for covering a continuous opening extending transversely across the width of the feed table, the cover web segments being loosely insertable from above adjacent to one another. The cover web segments are supported by their ends in an angular groove formed in lateral limits of the opening as well as on a support disposed centrally within the opening. According to the European patent, such an opening serves also to accommodate adjustably disposed side lays and the elements of a device for laterally aligning sheets which are transported across the feed table.

It has further become known from the aforementioned European patent to provide, instead of cover plates, a leaf-spring element or several leaf-spring elements, which are disposed upright i.e. edgewise, in the opening and which, with the upper side edge thereof, are disposed flatly in the plane of the surface of the feed table. These spring elements are disposed under preloaded tension, transversely to the conveying direction of the sheets across the feed table, so that when the side lay is adjusted in order to accommodate smaller sheet sizes or formats, the spring elements can be compressed and, when the side lay is adjusted in the opposite direction, the spring elements automatically follow such an adjustment. Although such a tightening is, to a very great extent, automatic in the sense of rationalizing changeover or conversion operations, it does not form a tight surface, with the result that, particularly in the case of thin paper sheets and at higher machine speeds, it is not possible to achieve sufficient operational reliability, especially the operational reliability which is attainable with conventional cover web segments.

Practical embodiments of such covering devices having cover web segments are known particularly in conjunction with devices for laterally aligning sheets in the feed table of printing presses, such as sheet-fed offset rotary printing presses, particularly. In such devices, a pulling bar is movably and drivingly mounted in the opening which extends transversely in the feed table, the pulling bar cooperating with a pulling roller for pressing the sheet with controllable tension against the surface of the pulling bar so that the sheet is aligned against the laterally disposed side lay, which is adjustable to the size or format of the sheet. The partial openings on opposite sides of the pulling bar after the side lay has been adjusted are covered by loosely insertable cover web segments, which are held in position either by magnets, for example, also in accordance with the disclosure in the aforementioned European patent, column 3, lines 1 to 5, or by material tension, so that, in the direction of sheet transport, there is a row of cover web segments located upstream of the pulling bar and a further row of cover web segments downstream of the pulling bar. Different widths of cover web segments offer the possibility of adapting to the respective position of the side lay. Changeover or conversion operations are time-consuming because of such cover web segments, due to the fact that, prior to each adjustment of the side lay, it is necessary to remove some of the cover web segments by hand and, after the side-lay adjustment, it is necessary to fit them in again in order to create space for the side-lay adjustment, as well as, once again to cover as completely as possible that region of the opening or partial openings which is covered by the sheet as it is transported across the feed table.

In order to reduce the manual labor which is involved, it has also become known heretofore to use, instead of cover web segments, slidable lattice grids which, however, are comparable in effect to the spring elements heretofore known from the aforementioned European patent.

It is accordingly an object of the invention to provide a covering device of the foregoing general type which automatically affords adjustment of the side lay and, nevertheless, maintains a closed, full-area covering of the side lay opening.

With the foregoing and other objects in view, there is provided, in accordance with the invention, a covering device for a side lay opening formed in a feed table of a sheet-processing machine and disposed transversely to a sheet-transport direction, wherein a bottom edge of at least one side lay for laterally aligning sheets travelling through the sheet processing machine in the sheet-transport direction dips into the side-lay opening to a location below the surface of the feed table, a holder for the side lay being disposed on a guide and being adjustable transversely with respect to the sheet-transport direction, and cover web segments mutually juxtaposed and in alignment with the surface of the table being disposed adjacent the side lay for covering the side lay opening, comprising spring means for bracing the cover web segments and biasing them in a direction perpendicular to the surface of the feed table, a sliding pad attached to the holder for the side lay, the sliding pad, in vicinity of the side lay, being actuable from above on the cover web segments for pressing the latter against the spring bias into the side lay opening, the sliding pad having a surface in alignment with the plane of the surface of the feed table adjacent to an inner side of the side lay directed towards a center of the sheet-processing machine.

In accordance with another feature of the invention, the sliding pad is formed with rising inclined surfaces on an underside thereof at respective ends disposed in a direction of adjustment thereof.

In this construction of the invention, the surfaces of the cover web segments lie integrally in the plane of the surface of the table. They are held in this position under the action of a spring, so that they can be pressed into the opening, vertically with respect to the surfaces of the table, against the spring bias. This movement is accomplished in the vicinity of the side lay by the sliding pad which advantageously, has a rigid connection to the holder to which the side lay is also attached and with which the side lay is adjustable on a support transversely to the sheet-transport direction. At the inside facing towards the center of the sheet-processing machine, the surface of the sliding pad is likewise disposed integrally in the plane of the surface of the feed table, due to which the sheet transported across the feed table and against the side lay is always safely supported by its side edge directly on the side lay and, in fact, on the surface of the sliding pad in this region.

When the holder is moved laterally for the purpose of adjusting the side lay, the sliding pad is also thus forcibly moved, with the result that it presses the cover web segments lying in the region of adjustment against the spring element and into the side lay opening, thereby permitting adjustment of the side lay. Consequently, when the side lay is being adjusted, the elements of the covering devices are no longer a hindrance, because they automatically follow the adjustment. This offers the advantage of being able to keep the cover web segments as narrow as possible in order to limit the width of the recess which forms next to the sliding pad on the inside facing towards the center of the sheet-processing machine.

Based on conventional construction of the elements of a device for laterally aligning sheets, a particular embodiment of the invention provides for cover web segments to be juxtaposed in two rows, of which, as viewed in the direction of transport of the sheet as it is transported across the feed table, one row is disposed upstream of a transversely extending pulling bar and a further row of covering segments is disposed downstream of the pulling bar. It is advisable in this connection to stagger the cover web segments of the two consecutive rows in the sheet-transport direction in order thereby to minimize irregularities in the surface of the table.

In accordance with a further feature of the invention, the side lay is adjustably attached to the holder, and the bottom edge thereof dips into a recess formed in the sliding pad.

In accordance with an added feature of the invention, there is provided a support extending parallel to and disposed below the side lay opening, and wherein the spring means comprise respective spring elements for bracing each of the cover web segments on the support.

In accordance with an additional feature of the invention, the cover web segments are formed with respective stop surfaces, and the support is formed with respective mating surfaces, the stop surfaces being cooperatively engageable with the mating surfaces for limiting upward movement of the cover web segments, under the action of the spring elements, to a position wherein the surface of the cover web segments is disposed in the plane of the surface of the feed table.

In accordance with yet another feature of the invention, the spring elements comprise helical springs, one end of the helical springs being in engagement with the underside of the respective cover web segments and the other end of the helical springs being in engagement with the support.

In accordance with yet a further feature of the invention, the spring elements are helical springs, and one end of each of the helical springs is held in a bore formed in a tubular projection on the underside of the cover web segments, and each of the stop surfaces limiting upward movement of the respective cover web segments under the action of the respective spring is formed on a lateral toe of the respective projection.

In accordance with yet an added feature of the invention, the spring elements are formed of a spring band or leaf spring, the spring band or leaf spring extending under a plurality of the cover web segments and being, in turn braced by shaped sections thereof alternatingly against a respective one of the cover web segments and against the support.

In accordance with yet an additional feature of the invention, there is provided a guide wherein the holder is slidably disposed at one side thereof, and means located at the other side of the holder for clamping the holder in a set position to a structural part of the feed table.

In accordance with still another feature of the invention, the clamping means comprise an eccentric bolt disposed below the feed table on an arm connected to the holder, and being eccentrically adjustable against the underside of the feed table.

In accordance with still a further feature of the invention, there is provided a pulling roller and a pulling bar underlying the pulling roller, the pulling bar being movably disposed transversely to the sheet-transport direction in the side lay opening so as to define partial openings on opposite sides of the pulling bar, the partial openings being respectively separately covered by the cover web segments arranged mutually adjacent one another in respective rows, the sliding pad being formed with a recess overlapping the pulling bar, respective parts of the sliding pad o opposite sides of the recess being engageable with the respective rows of mutually adjacent cover web segments.

In accordance with still an added feature of the invention, the cover web segments of one of the rows thereof are offset with respect to the cover web segments of the other of the rows thereof.

In accordance with a concomitant feature of the invention, the side lay extends transversely across the pulling bar, and the respective parts of the sliding pad are each formed with a recess for receiving respective end portions of the side lay therein.

Other features which are considered as characteristic for the invention are set forth in the appended claims.

Although the invention is illustrated and described herein as embodied in a covering device for a side lay opening in a feed table of a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
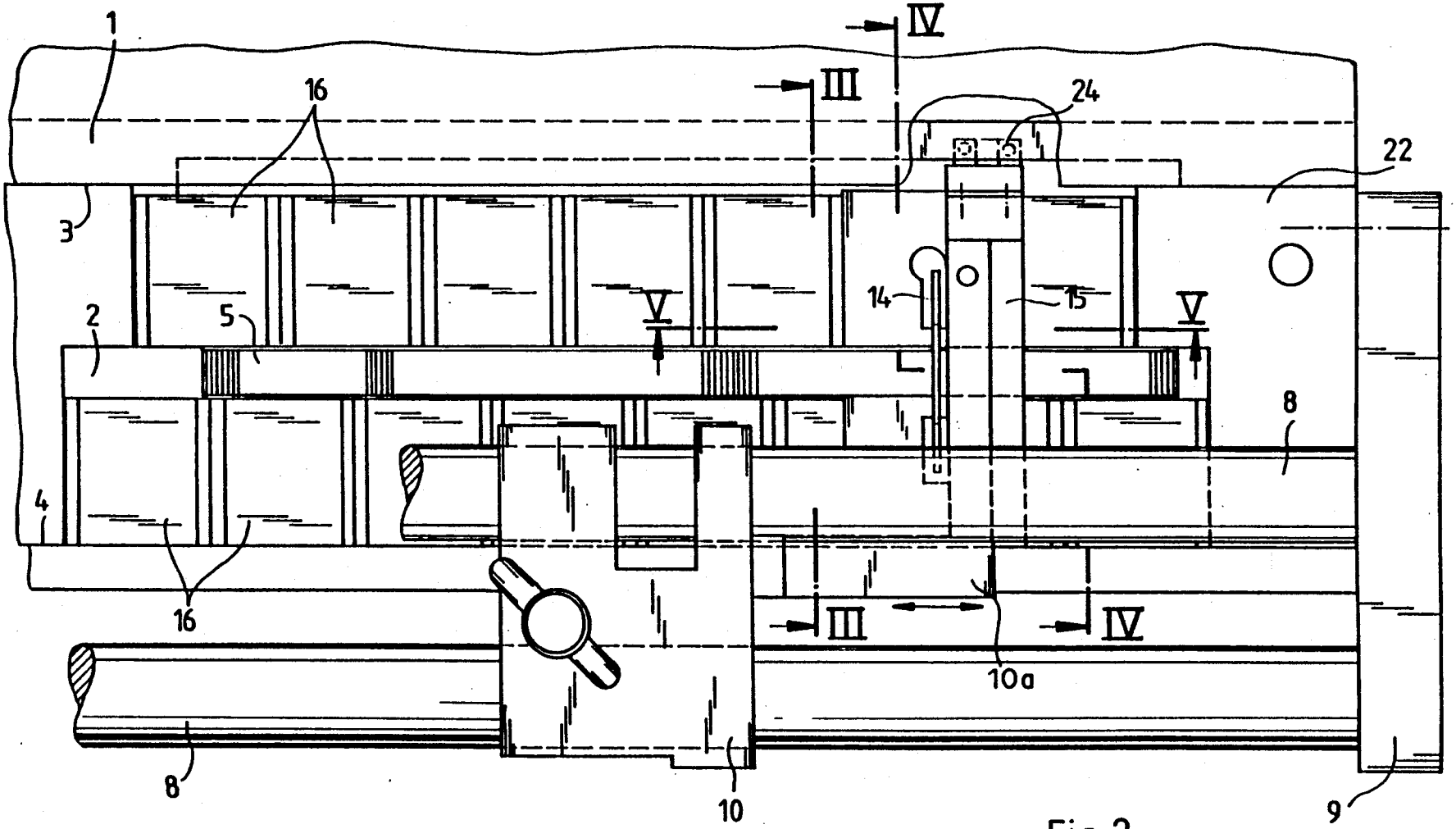
FIG. 2 is a diagrammatic top plan view of a device similar to that of FIG. 1 with part of the structure thereof omitted in the interest of clarity.
Figure 2A:
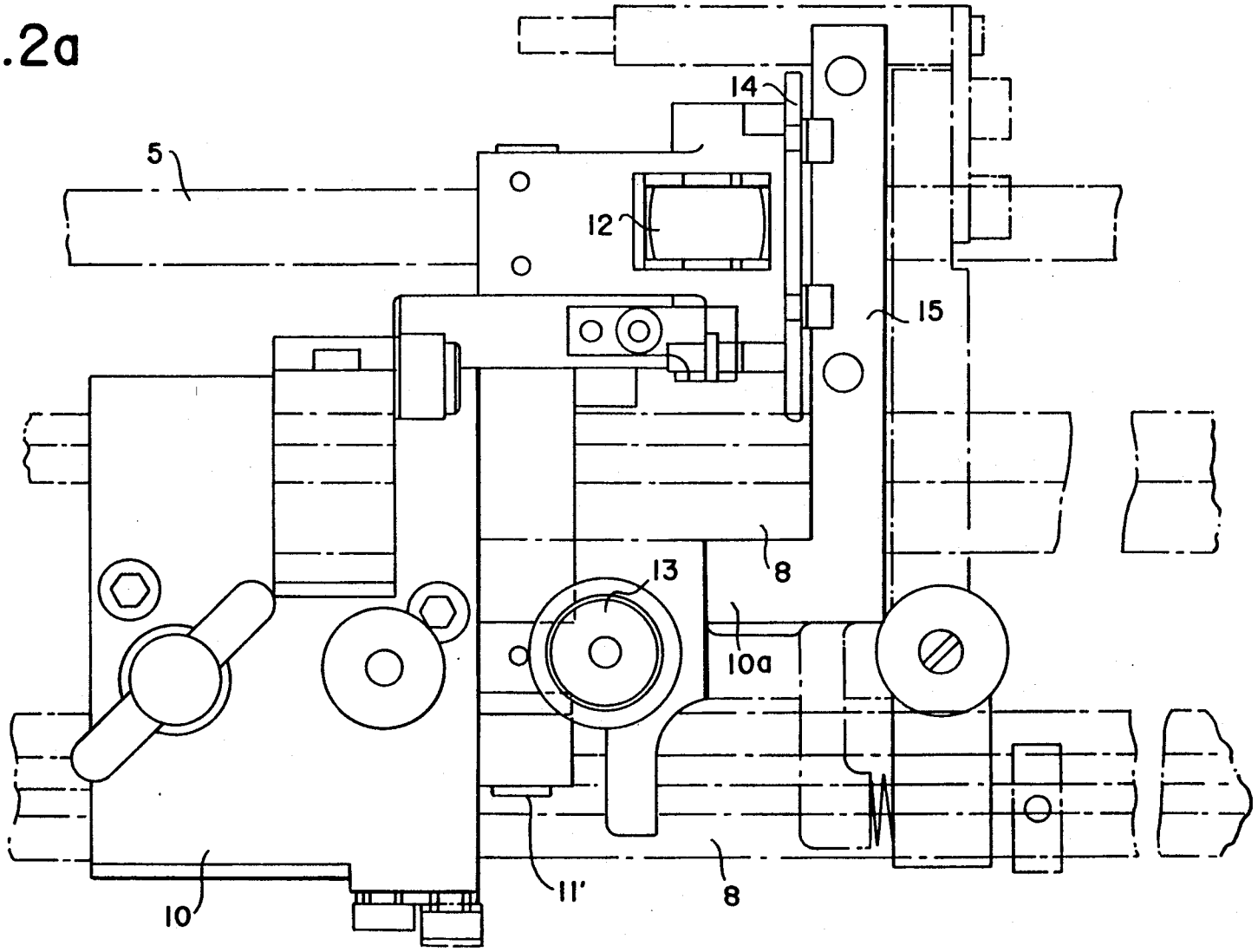
Figure 2B:
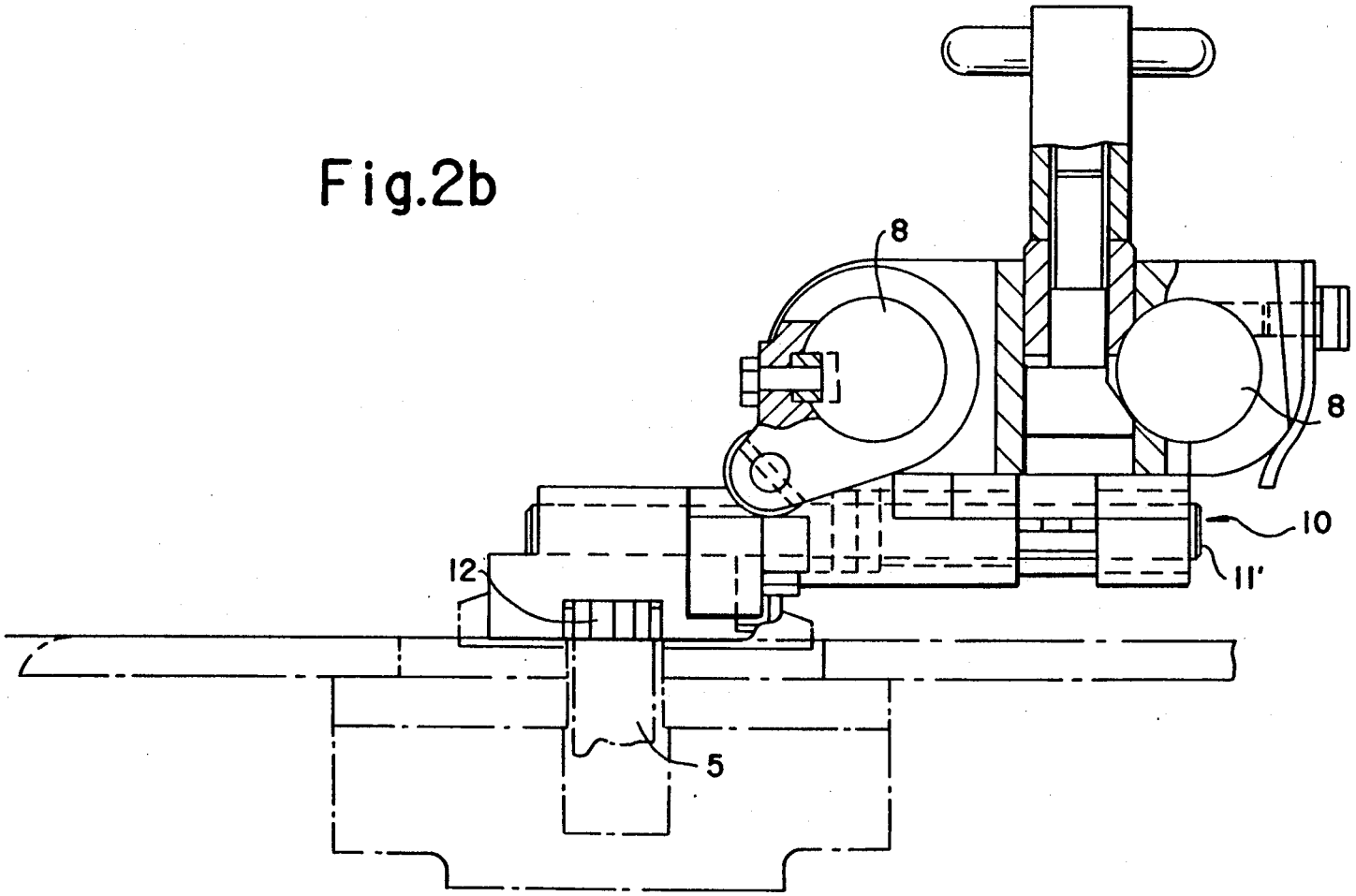
Figure 3:
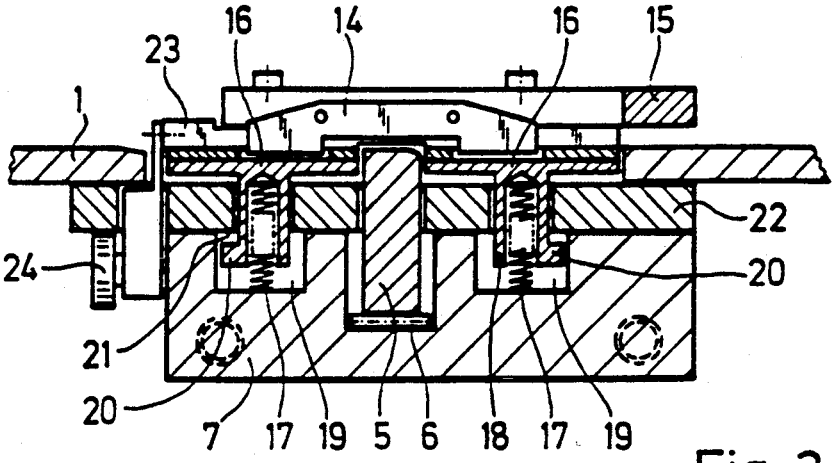
Figure 4:
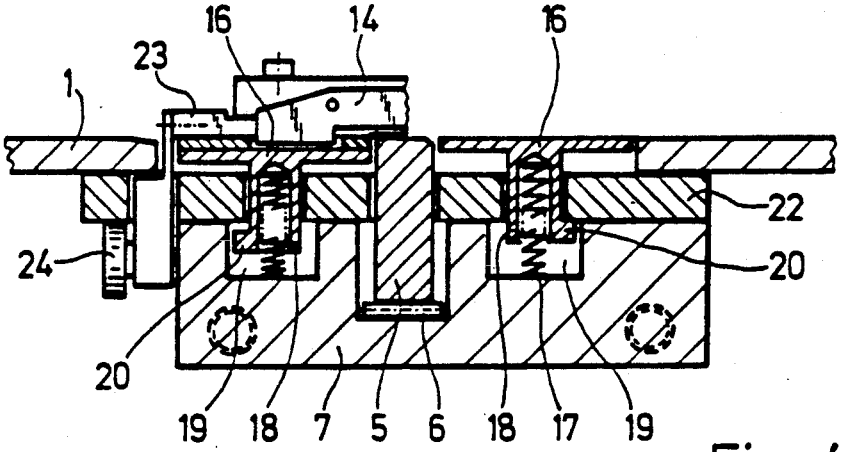
Figure 5:
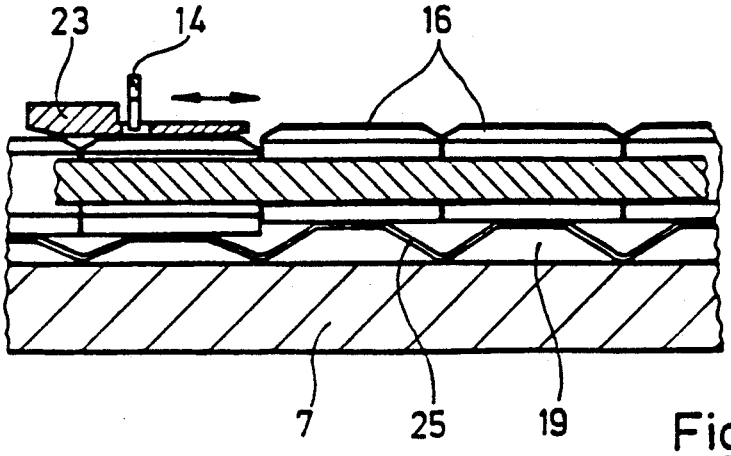
Figure 6B:
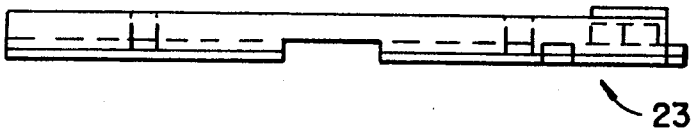
Figure 6A:
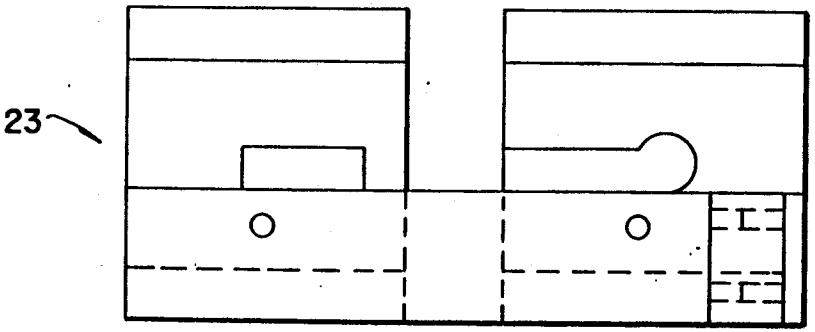
Figure 6C:
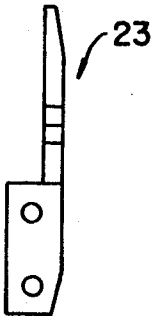
Figure 7B:
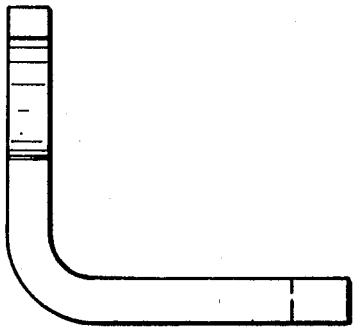
Figure 7A:
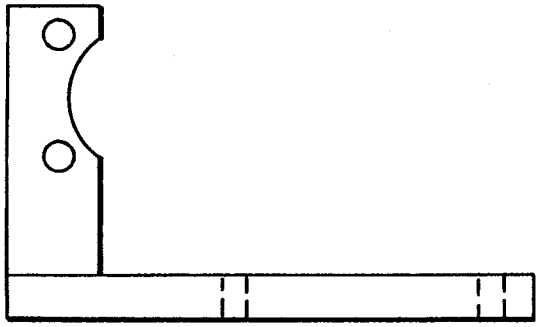
Figure 7C:
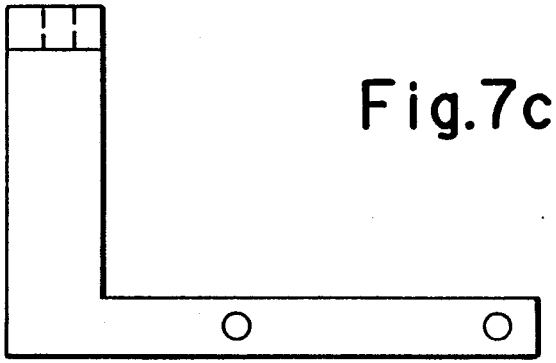

FIG. 2*a* is a slightly enlarged view of FIG. 2 with the omitted structure restored;

FIG. 2*b* is a view from the left hand side of FIG. 2, partly in section;

FIG. 3 is a fragmentary cross-sectional view of FIG. 2 taken along the line III—III in the direction of the arrows;

FIG. 4 is a fragmentary cross-sectional view of FIG. 2 taken along the line IV-IV in the direction of the arrows;

FIG. 5 is a fragmentary cross-sectional view of FIG. 2 taken along the line V—V in the direction of the arrows, having, however, a modified construction of spring elements thereof in comparison with those of the embodiment of FIG. 2;

FIGS. 6*a*, 6*b* and 6*c* are plan, front and side elevational view, respectively, of a structural feature of the invention, namely a sliding pad 23; and FIGS. 7*a*, 7*b* and 7*c* are plan, front and side elevational views, respectively, of another structural feature of the invention, namely a holding arm 15 thereof.

Figure 1:
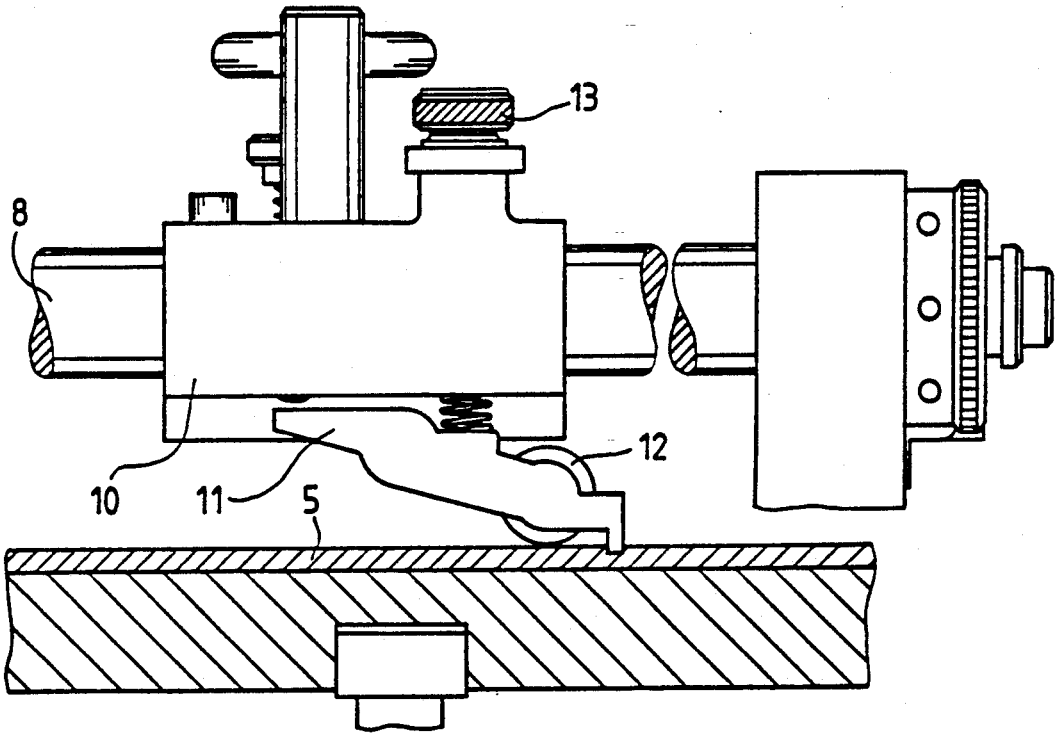
FIG. 1 is a front elevational view, partly in section, and as seen in a direction of transport of a sheet, of a side lay and of a device for laterally aligning the sheet with a pulling bar.

Referring now to the drawing and, first, particularly to FIG. 2 thereof, there is shown therein in a top plan view, a detail of a feed table 1 for sheets of a sheet-processing machine. Starting from one side of the feed table, an opening 2 having parallel limits 3 and 4 extends over at least part of the width of the feed table 1 transversely to the travel direction of the sheets which are transported across the feed table 1. In the embodiment of the invention illustrated in FIG. 2, approximately in the center of the opening 2 and parallel to the limits or sides 3 and 4 thereof, there is disposed a pulling bar 5 which is movable in the longitudinal direction thereof on a roller bearing 6 and supported therewith in a bracket 7 (note: FIGS. 3 to 5) extending over the width of the feed table 1 and connected to a non-illustrated conventional drive for moving the pulling bar 5. Above the feed table 1 and extending transversely across the latter are support beams 8 having ends which are attached to side frames 9 of the processing machine. A holder 10 is adjustably attachable to the support beam 8 and is equipped in a conventional manner with adjusting means for coarse and fine adjustment. As shown in the elevational view of FIG. 1, on the underside of holder 10, an oscillating arm 11 is disposed so as to be turnable about a shaft 11' lying parallel to the sheet-transport direction. The oscillating arm 11 carries an axially parallel pulling roller 12, which is controllably pressed against the surface of the pulling bar 5 by a fine adjuster 13. A side lay 14 (also note: FIGS. 2 and 2*a*) is releasably and adjustably connected to the oscillating arm 11. According to the cross-sectional view of the embodiment of the invention in FIG. 3, the side lay 14 overlaps the pulling bar 5 and is formed with a bottom edge on two downwardly extending ends thereof dipping downwardly into the opening 2 to a location below the surface plane of the feed table 1. In the illustrated embodiment, the side lay 14 is disposed on a holding arm 15 which is rigidly connected by an extension 10*a* (note: FIG. 2) to the holder 10 and permits the side lay 14 to be disposed at a given lateral spacing from the location at which the pulling roller 12 makes contact with the surface of the pulling bar 5. On both sides of and adjacent the centrally extending pulling bar 5, the opening 2 is covered by cover web segments or plates 16, which are disposed in two rows on opposite adjacent sides of the pulling bar 5. The cover web segments 16 have surfaces which lie integrally in the plane of the surface of the feed table 1 and are resiliently braced against a spring device so as to be movable vertically with respect to the surface of the feed table 1. For this purpose, each cover web segment 16 is supported on the spring device, which exerts a tensioning force biasing the respective cover web segment 16 in an upward direction, as viewed in FIGS. 3 to 5. In the embodiment as shown in FIGS. 3 and 4, the spring device includes, for each cover web segment 16 a helical spring 17, having one end thereof held in a tubular projection 18 on the underside of the cover segment 16, and having the other end thereof supported on or braced against a bottom surface defining a recess 19 formed in the bracket 7. A cam or toe 20 located on the outside of the tubular projection 18 of each cover segment 16 is formed with a stop surface, which cooperates with a mating stop surface 21 formed on the underside of a plate 22 forming an upper part of the bracket 7, so that the corresponding stop surfaces, as a result of the mutual contact thereof, limit any upward movement of the surface of the cover segment 16 beyond the plane of the surface of the feed table 1. According to the views of FIGS. 3 and 4, such a construction is provided on both sides of and adjacent the pulling bar 5. Furthermore, a sliding pad 23 is rigidly attached to the holding arm 15 and, in the vicinity of the side lay 14, acts from above on the cover web segments 16 on opposite sides of the pulling bar 5 and presses the cover web segments 16 downwardly into the opening 2 against the action of the helical spring 17, so that the cover web segments 16 do not obstruct the lateral movement of the side lay 14 when it is being adjusted. The sliding pad 23 is formed with rising inclined surfaces on its underside at both ends thereof which are disposed in a direction of movement thereof. These rising inclined surfaces permit the cover web segments 16 to be forced away and gently returned to the normal position thereof. Furthermore, near an inside location of the side lay 14, the inside location being directed towards the center of the sheet-processing machine, the surface of the sliding pad 23 is likewise integrated into the plane of the surface of the feed table 1, so that the sheet, aligned laterally against the pull-type lay by the pulling bar and the pulling roller, is always provided with secure support in the vicinity of the pull-type lay. FIG. 3 shows a pair of the cover web segments 16 in a lowered position, while, in FIG. 4 the cover web segment shown at the right-hand side of the figure, has already been released again by the sliding pad 23 and has returned to the upper end position thereof due to the restoring action of the spring element 17.

FIGS. 6*a*, 6*b* and 6*c* show the specific construction of the sliding pad 23 in greater detail.

In order to improve the stability of the holding arm 15, in a particular construction of the invention, the holding arm 15, respectively, may be clamped at a free end thereof to the structure of the feed table 1 or to a substructure which stiffens the feed table 1, or may be adjustable in height. As shown in FIGS. 3 and 4, a rotatable eccentric bolt 24 is provided, which is held on a part passing through a guide in the feed table 1. For the purpose of adjusting the sliding pad 23 with respect to the side lay 14, the eccentric bolt 24 is loosened and is tightened again after adjustment. To avoid the necessity for having a wide gap to permit that part of the holding arm 15 on which the eccentric bolt 24 is held to pass therethrough, that part of the holding arm 15 is connected to the holding arm 15 by a thin strip merely loaded in tension. FIGS. 7*a*, 7*b* and 7*c* show the specific construction of the holding arm 15 in greater detail.

Instead of the spring elements being formed of helical springs 17, an alternate embodiment of the invention shown in FIG. 5 has a wave-shaped leaf spring 25, which is braced alternatingly against the defining bottom surface of the recess 19 formed in the bracket 7 and against the underside of block-shaped covering segments 16'. FIG. 5 includes a cross-sectional view of the sliding pad 23 provided also in the embodiment of FIGS. 3 and 4. The surface of the sliding pad 23 located towards the right-hand side of the adjustable side lay 14 in FIG. 5 is disposed in the plane of the surface of the cover web segments 16'.

What is claimed is:

1. Covering device for a side lay opening formed in a feed table of a sheet-processing machine and disposed transversely to a sheet-transport direction, wherein a bottom edge of at least one side lay for laterally aligning sheets travelling through the sheet processing machine in the sheet-transport direction dips into the side-lay opening to a location below the surface of the feed table, a holder for the side lay being disposed on a guide and being adjustable transversely with respect to the sheet-transport direction, and cover web segments mutually juxtaposed and in alignment with the surface of the table being disposed adjacent the side lay for covering the side lay opening, comprising spring means for bracing the cover web segments and biasing them in a direction perpendicular to the surface of the feed table, a sliding pad attached to the holder for the side lay, said sliding pad, in vicinity of the side lay, being actuable from above on the cover web segments for pressing the latter against said spring bias into the side lay opening, said sliding pad having a surface in alignment with the plane of the surface of the feed table adjacent to an inner side of the side lay directed towards a center of the sheet-processing machine.

2. Covering device according to claim 1, wherein said sliding pad is formed with rising inclined surfaces on an underside thereof at respective ends disposed in a direction of adjustment thereof.

3. Covering device according to claim 1, wherein the side lay is adjustably attached to the holder, and the bottom edge thereof dips into a recess formed in the sliding pad.

4. Covering device according to claim 1, including a support extending parallel to and disposed below the side-lay opening, and wherein said spring means comprise respective spring elements for bracing each of the cover web segments on said support.

5. Covering device according to claim 4, wherein the cover web segments are formed with respective stop surfaces, and said support is formed with respective mating surfaces, said stop surfaces being cooperatively engageable with said mating surfaces for limiting upward movement of the cover web segments, under the action of said spring elements, to a position wherein the surface of the cover web segments is disposed in the plane of the surface of the feed table.

6. Covering device according to claim 4, wherein said spring elements comprise helical springs, one end of said helical springs being in engagement with the underside of the respective cover web segments and the other end of said helical springs being in engagement with said support.

7. Covering device according to claim 5, wherein said spring elements are helical springs, and wherein one end of each of said helical springs is held in a bore formed in a tubular projection on the underside of the cover web segments, and each of said stop surfaces limiting upward movement of the respective cover web segments under the action of the respective spring is formed on a lateral toe of the respective projection.

8. Covering device according to claim 4, wherein said spring elements are formed of a spring band or leaf spring, said spring band or leaf spring extending under a plurality of said cover web segments and being, in turn braced by shaped sections thereof alternatingly against a respective one of said cover web segments and against said support.

9. Covering device according to claim 3, including a guide wherein the holder is slidably disposed at one side thereof, and means located at the other side of the holder for clamping the holder in a set position to a structural part of the feed table.

10. Covering device according to claim 9, wherein said clamping means comprise an eccentric bolt disposed below the feed table on an arm connected to the holder, and being eccentrically adjustable against the underside of the feed table.

11. Covering device according to claim 1, including a pulling roller and a pulling bar underlying said pulling roller, said pulling bar being movably disposed transversely to the sheet-transport direction in the side lay opening so as to define partial openings on opposite sides of the pulling bar, said partial openings being respectively separately covered by said cover web segments arranged mutually adjacent one another in respective rows, said sliding pad being formed with a recess overlapping said pulling bar, respective parts of said sliding pad on opposite sides of said recess being engageable with the respective rows of mutually adjacent cover web segments.

12. Covering device according to claim 11, wherein the cover web segments of one of said rows thereof are offset with respect to the cover web segments of the other of said rows thereof.

13. Covering device according to claim 11, wherein the side lay extends transversely across the pulling bar, and the respective parts of said sliding pad are each formed with a recess for receiving respective end portions of said side lay therein.

* * * * *